US006513888B1

(12) United States Patent
Lucht

(10) Patent No.: US 6,513,888 B1
(45) Date of Patent: Feb. 4, 2003

(54) PALLET MOUNTED MERCHANDISING DISPLAY

(75) Inventor: Wayne Lucht, Bedford Park, IL (US)

(73) Assignees: Midwest Quality Gloves, Inc., Chillicothe, MO (US); Midway Displays, Inc., Bedford Park, IL (US)

( * ) Notice: Subject to any disclaimer, the term of this patent is extended or adjusted under 35 U.S.C. 154(b) by 0 days.

(21) Appl. No.: 09/798,493

(22) Filed: Mar. 2, 2001

Related U.S. Application Data

(63) Continuation-in-part of application No. 09/713,439, filed on Nov. 15, 2000, now Pat. No. 6,428,123.

(51) Int. Cl.[7] ..... A47F 3/00

(52) U.S. Cl. ..... 312/138.1; 312/114; 108/55.1

(58) Field of Search ..... 312/138.1, 102, 312/117, 128, 310, 139, 139.1, 139.2, 327, 270.1, 114, 249.8, 249.9, 311; 211/126.1, 126.2, 126.5; 49/104, 80.1, 367; 108/51.11, 55.1

(56) References Cited

U.S. PATENT DOCUMENTS

| | | | | | |
|---|---|---|---|---|---|
| 352,828 | A | * | 11/1886 | Lee | 312/139.1 X |
| 774,540 | A | * | 11/1904 | Stenshaug | 312/138.1 X |
| 845,829 | A | * | 3/1907 | Tacke | 312/139.1 |
| 1,713,661 | A | * | 5/1929 | Kemball et al. | 312/117 |
| 2,941,772 | A | * | 6/1960 | Thayer et al. | 108/53.1 |
| 3,070,853 | A | * | 1/1963 | Brenner | 49/80.1 |
| 3,506,138 | A | * | 4/1970 | Travis | 108/91 |
| 3,966,221 | A | * | 6/1976 | Beam et al. | 280/79.3 |
| 4,052,084 | A | * | 10/1977 | Propst | 108/55.1 X |
| 4,368,675 | A | * | 1/1983 | Propst et al. | 108/55.1 X |
| 4,377,241 | A | * | 3/1983 | Schreiner | 108/55.1 X |
| 5,233,931 | A | * | 8/1993 | McCorkle, Jr. | 108/55.1 |
| 5,269,597 | A | * | 12/1993 | Yenglin et al. | 312/138.1 X |

FOREIGN PATENT DOCUMENTS

| | | | | |
|---|---|---|---|---|
| DE | 4335544 | * | 3/1994 | 108/55.1 |
| EP | 376799 | * | 7/1990 | 108/55.1 |
| GB | 2000101 | * | 1/1979 | 108/55.1 |

* cited by examiner

*Primary Examiner*—Lanna Mai
*Assistant Examiner*—Hanh V. Tran
(74) *Attorney, Agent, or Firm*—Leydig, Voit & Mayer, Ltd.

(57) ABSTRACT

A merchandising display includes a housing for sheltering and protecting a displayed product whether indoors or outdoors, a pallet carried support frame is mounted within the housing and adapted for displaying the product within the display. The housing has a front and rear wall each formed by a series of vertically extending, transparent doors, a roof, a floor and side walls. Each door selectively pivots between an open position and a closed position and has side lips that engage and extend over a side edge of the housing when in the closed position. At least some of the doors have a bottom lip that engages and extends over an adjacent door's front surface, and at least one of the doors engages a pivotable roof flap when in the open and closed positions, to continuously shelter the displayed products whether the doors are in an open or closed position. The support frame includes sets of cross-bars, and spaced vertical supports. The bars are adapted for mounting a clip-on pivotal shelf thereto and the bottom bars are for supporting the shelf.

8 Claims, 2 Drawing Sheets

PALLET MOUNTED MERCHANDISING DISPLAY

CROSS-REFERENCE TO RELATED PATENT APPLICATIONS

This patent application is a continuation-in-part of Lucht et al. U.S. patent application Ser. No. 09/713,439, filed Nov. 15, 2000, now U.S. Pat. No. 6,428,123, on Product Display and related Lucht U.S. design patent application Ser. No. 29/130,479, filed Oct. 2, 2000, now U.S. Pat. No. D4,440,006, on Merchandising Display.

FIELD OF THE INVENTION

This invention related generally to a stand-alone, transportable merchandising display that shelters and protects the products and may be used in an outdoor environment. More specifically, the display is pallet mounted for movement by a forklift, and it is easily assembled and stocked.

BACKGROUND OF THE INVENTION

A variety of merchandising displays are known. However, many are not permanent, transportable or stand-alone type displays for indoor and outdoor use. Importantly, many displays do not adequately shelter the displayed products for use outdoors. Others, while usable outdoors, are difficult and inefficient to assemble, stock, restock, and may not even adequately ventilate the displayed products. The aforementioned pending applications do show and describe a solution to the aforementioned problems, but there was still a need for suitable alternatives.

BRIEF SUMMARY OF THE INVENTION

Therefore, a primary object of the subject invention is to provide an easily assembled, transportable, stand-alone, sheltered merchandising display that accommodates prepacked products on shelves to display the products, and has a front and rear series of vertically extending transparent doors corresponding to each layer of shelves.

Another important object of the subject invention is to provide a merchandising display as described above wherein the products may be selectively stocked and restocked and individual products can be removed from either the front or rear side of the display while the other displayed products remain sheltered.

Yet another important object of the subject invention is to provide a sheltered merchandising display that is easily moved with a forklift such as ones manually operated or carried on a vehicle.

Yet another object of the subject invention is to provide a sheltered merchandising display that is easy to assemble and relatively lightweight and inexpensive.

These objects are attained by providing a merchandising display comprising a housing for sheltering displayed products from the weather, a support frame mounted within the housing and adapted for carrying prepackaged products within the display. The housing has a roof, floor, side walls and a front and rear wall presented by a series of vertically extending, transparent doors. Each door is selectively movable between an open and a closed position and has side lips that engage and extend over a side edge of the housing when closed. At least some of the doors have a bottom lip that engages and extends over an adjacent door's front surface, and at least one of the doors engages a pivotable flap member on the roof. The lips and flap member thus shelter the displayed products whether the doors are in an open or closed position. The support frame includes sets of crossbars, each set having a top bar spaced apart from a bottom bar. The top bars are adapted for mounting clip-on pivotal shelves thereto and the bottom bars are for supporting the shelf. The support frame is carried on a pallet by support brackets. Also, an accessible space for product storage is provided at the lower end of the display.

DETAILED DESCRIPTION OF THE INVENTION

Figure 1:
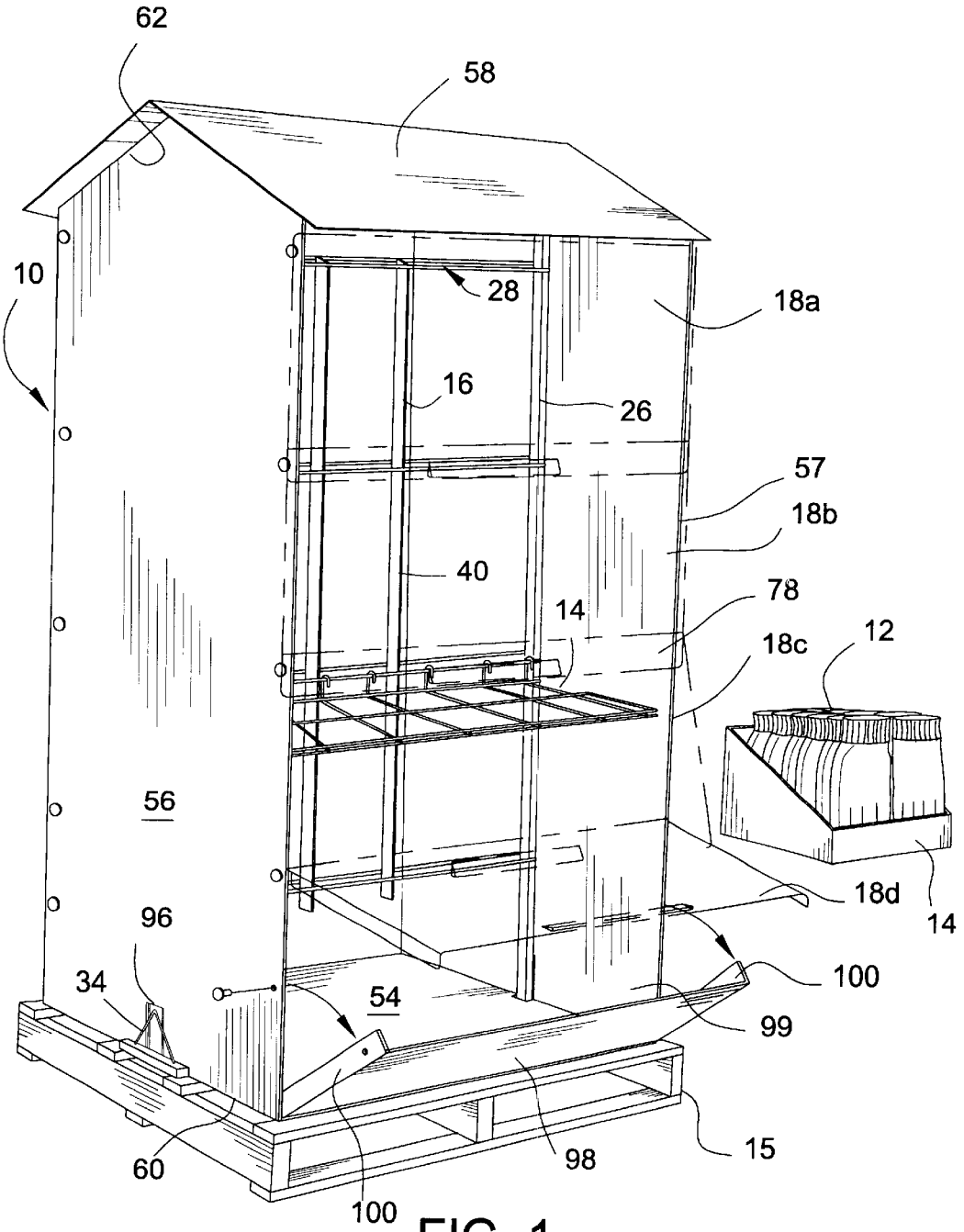
FIG. 1 is a front perspective view of a merchandising display in accordance with the present invention, here showing an exemplary product of prepackaged gloves displayed herein.
Figure 2:
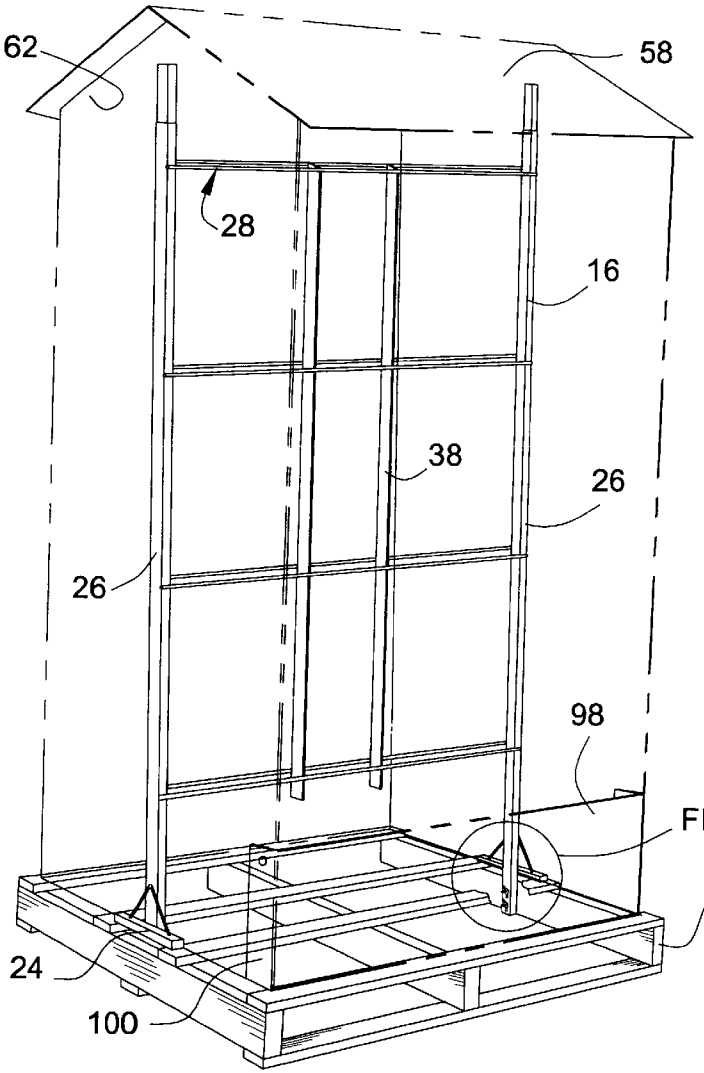
FIG. 2 is a perspective front view of the merchandising display of FIG. 1 partly in phantom illustrating the internal support structure.
Figure 3:
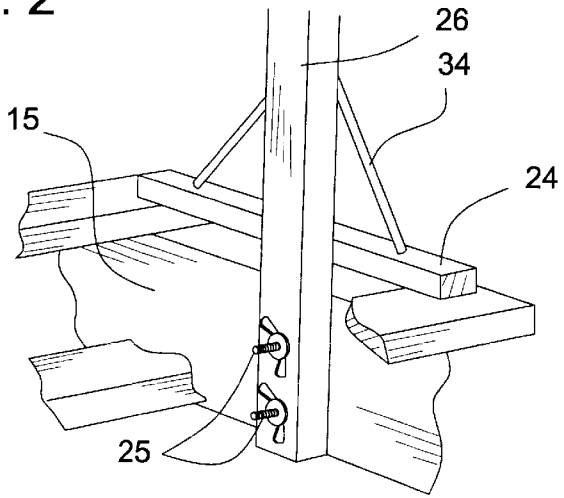
FIG. 3 is a fragmentary perspective view of the pallet attachment portion.
Figure 4:
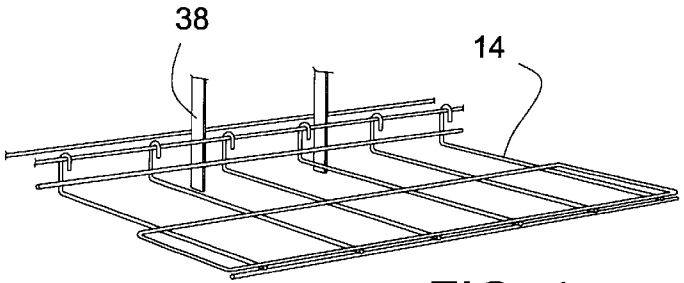
FIG. 4 is a perspective view of an exemplary shelf for use with the display.

A merchandising display 10 in accordance with the present invention is shown in FIGS. 1–3. In the present instance, products such as prepacked gloves 12 are shown displayed and will be referred to herein; however, display 10 can be used for a variety of other products. Display 10 is usable indoors or outdoors and as such, adequately shelters the gloves 12 from the elements, such as rain and snow. As shown in FIGS. 1 and 2, merely by way of example, prepackaged gloves 12 are stored on display shelves 14 that clip onto the display's interior structural frame 16 that is carried by a pallet 15. Doors 18, arranged in a vertically stacked configuration form the front and rear walls of the housing of the display 10, perform the dual function of allowing easy accessibility to gloves 12 and sheltering the gloves 12 even during removal and restocking thereof.

As best seen in FIGS. 2 and 3, interior structural frame 16 includes pallet mounting brackets 24, side wall supports 26 and shelf support 28. Pallet brackets 24 lower ends present a T-shape brackets 24 connected to side wall supports 26 at a 90° angle. Angle braces 34 secure the brackets 24 in place. Specifically, each pair of angle braces 34 presents a triangle, with each brace end being welded to the corresponding bracket 24 of pallet support 26 and the other end of each brace 34 being welded to the upright sidewall support 26.

Each side wall support 26 is rigidly and securely mounted upwards from one end onto each pallet bracket 24 mounting so that a portion extends downwardly and can be bolted with bolts 25 to the pallet sides while the brackets 24 rest on the top of the pallet 15.

As seen in FIG. 2, shelf support 28 presents opposed grid-type supports to which shelves 14 are clipped and may not be rotated or pivoted upwardly. Because the grids are mirror images, only one will be discussed in detail. As seen in FIG. 2, shelf support 28 includes cross members 38 and vertical supports 40.

The vertical supports 40 extend from the uppermost top bar 42 to the lowermost bottom bar 44. A vertical support 40 is mounted spaced from each side wall support 26.

The floor 54, side walls 56 and 57 are lightweight and water resistant, preferably being formed of the same material such as a plastic corrugated sheet. As seen in FIG. 1, floor 54 is mounted on the pallet 15, with each comer thereof being adjacent or abutting the bottom edge of a side wall 56. The floor 54 is thus held in position by the pallet top, brackets 34 and side walls 56,57. The floor 54 has flaps 98 that can fold up to form a compartment beneath the lower shelf.

As best seen in FIG. 1, side walls 56,57 are identical, mirror images of one another and thus, only one will be discussed in detail. Side wall 56 is secured over the exterior surface of the side wall support 26 preferably with Christmas tree push pins which extend through the side wall 56 into receiving apertures formed in the side wall support 26. The bottom edge 60 of the side wall 56 is spaced just above or adjacent the side edge of the floor 54. A notch 96 in the side wall 56 accommodates the pallet support bracket 24. The top portion 62 of the side wall 56 presents a peaked or triangularly shaped roof line and includes flaps (not shown) that fold inwardly from the edges thereof to secure to side walls 56 to the roof 58. The side edges 60 of the side wall 56 taper slightly outwardly and downwardly from the top portion 62. Thus, the side wall 56 is narrower in width at the top than at the bottom.

The roof 58 is secured over the side walls 56,57 the flaps, preferably by plastic screws and wing nuts (not shown) in a conventional manner. As seen in FIG. 1, the front and rear edges of the roof 58 hang over or extend beyond the doors 18 and likewise, the sides of the roof 58 hang over or extend beyond the side walls 56,57.

A set or series of adjacent, vertically extending, overlapping transparent doors 18 forms the front wall and another set of doors 18 forms the rear wall of the display 10. Because each set is identical and a mirror image of the other, only one set will be discussed in detail.

Preferably and as shown, a series of four doors 18*a–d* form the front wall. Each door 18*a–d* is hingedly attached between the side walls 56 by a horizontally extending hinge rod and includes a bottom, flared portion or lip 78 that overlaps the next adjacent door 18 and may act as a handle. Each bottom lip 78, as best seen in FIG. 1, overlaps the top portion of the next adjacent door 18 in the series, except the bottom lip 78 of the lowermost door 18d in the series which is spaced from the floor 54 to present another venting area. The top edge of the uppermost door 18*a* in the series engages a roof flap 70. This door configuration thus helps shelter and protect the gloves 12 from the weather during storage and removal thereof.

In operation, prepacked trays 14 full of gloves 12 are placed on the shelves 14 to load the product display 10. Prepacked trays 14 allow easy loading and restocking of the gloves 12 by reducing interference between the gloves 12 and are economical. Shelves 14 include hooks that mount the shelves 14 to the top cross-bars 38.

In the present display, the gloves 12 are continuously protected from the weather, whether during storage in the display 10 or during restocking or removal of the gloves 12. The doors form the front and rear walls to completely enclose the gloves when closed. The configuration of the doors' side and bottom lips and the roof flap, help protect the displayed gloves during the removal or restocking of gloves. In other words, the front and rear walls remain intact, except at the open door position. However, because the doors are hinged at their top edge, an open door also provides shelter to gloves being removed or restocked.

In accordance with another aspect of the invention, there is provided a lower door panel or flap 98 which is crease hinged at the bottom and has side flaps 58 that can be fastened to the side walls 56,57 with push fasteners or the like. This provides a storage space 99 below the lowest shelf 14. The shelf can be pivoted upwardly for access to the space or the panel 98 can be opened downwardly to access the storage space. This can be conveniently used to store restocking inventory.

With the pallet mounted arrangement the merchandising display can be easily lifted by a manual or vehicle mounted fork lift so it can be repositioned or relocated as desired.

What is claimed is:

1. A merchandising display, comprising:

a housing including side walls and a roof for sheltering products stored and displayed therein;

a support frame defined by at least a pair of spaced apart supports mounted within said housing and including vertically spaced cross members adapted for receiving a product for display;

said housing having at least one door wall presented by a vertically extending series of doors and a pivotal flap member, each one of said doors selectively movable between an open and a closed position, each one of said doors corresponding to one of said cross members to present vertically extending product bays from which and into which a product may be selectively removed and inserted when said door thereof is in said open position;

a pallet having a top and sides forming a base for said display, and bracket members fixed at 90° to said support frame supports and attachable to the top of said pallet, said supports being affixed to the respective pallet sides, and each bracket having braces fixed between the supports and bracket members.

2. A merchandising display as claimed in claim 1 wherein at least one of the doors overlaps another one of the doors in the closed position.

3. A merchandising display as claimed in claim 1 wherein said housing roof overhangs said door wall, said flap member extending inwardly from an overhanging edge of said roof and pivoting about said edge as said uppermost door moves between said closed and open positions.

4. A merchandising display as claimed in claim 2 wherein the door wall includes an openable flap member hinged upwardly at the lower portion for storing products in a space beneath the lower most cross member.

5. A merchandising display as claimed in claim 1 wherein there is a second door wall on the side opposite to said first door wall.

6. A merchandising display as claimed in claim 5 wherein said support frame has a second set of shelves accessible through said second door wall.

7. A merchandising display, comprising:

a housing for sheltering displayed products and having a floor, a roof, side walls, a front wall and a rear wall;

a support frame including a pair of spaced apart supports mounted to said housing and adapted for receiving shelves for the displayed products; a pallet carrying said support frame having a top and side walls;

said roof overhanging said housing side walls and said front and rear housing walls and having a pivotal flap member;

said front and rear housing walls each being presented by a vertically extending series of doors, each said door selectively movable between an open and a closed position;

bracket means fixed at 90° to the lower ends of said support frame supports, and said bracket means being attachable to said pallet top with the lower ends of the supports attached to the respective pallet side walls, and braces extending between the bracket means and frame supports.

8. A merchandising display as claimed in claim 7 wherein said braces are angularly fixed defining a triangle shape.

* * * * *